US008029184B2

(12) United States Patent
Hoogland

(10) Patent No.: US 8,029,184 B2
(45) Date of Patent: Oct. 4, 2011

(54) APPARATUS AND METHOD FOR MIXING COMPONENTS

(75) Inventor: Hans Hoogland, Vlaardingen (NL)

(73) Assignee: Conopco Inc., Englewood Cliffs, NJ (US)

( * ) Notice: Subject to any disclaimer, the term of this patent is extended or adjusted under 35 U.S.C. 154(b) by 0 days.

(21) Appl. No.: 12/773,872

(22) Filed: May 5, 2010

(65) Prior Publication Data

US 2010/0215829 A1 Aug. 26, 2010

Related U.S. Application Data

(62) Division of application No. 10/568,562, filed as application No. PCT/EP2004/008255 on Jul. 23, 2004, now abandoned.

(30) Foreign Application Priority Data

Aug. 21, 2003 (EP) ..... 03077612

(51) Int. Cl.
*B01F 13/10* (2006.01)

(52) U.S. Cl. ..... 366/160.1

(58) Field of Classification Search ..... 366/160.1
See application file for complete search history.

(56) References Cited

U.S. PATENT DOCUMENTS

| | | | | |
|---|---|---|---|---|
| 3,669,900 | A * | 6/1972 | Cummings | 366/279 |
| 4,423,084 | A * | 12/1983 | Trainor et al. | 426/589 |
| 4,753,370 | A | 6/1988 | Rudick | |
| 4,919,950 | A * | 4/1990 | Mak | 426/233 |
| 5,230,443 | A | 7/1993 | Du | |
| 6,280,075 | B1 | 8/2001 | Cadeo | |
| 6,849,282 | B2 * | 2/2005 | Gao et al. | 426/46 |
| 2006/0209624 | A1 * | 9/2006 | Hoogland | 366/160.1 |

FOREIGN PATENT DOCUMENTS

WO 01/00521 A1 1/2001

OTHER PUBLICATIONS

International Search Report PCT/EP2004/008255, 2 pages, dated Nov. 2004.

* cited by examiner

*Primary Examiner* — Tony G Soohoo
(74) *Attorney, Agent, or Firm* — Karen E. Klumas

(57) ABSTRACT

The invention relates to an apparatus suitable for preparing a variety of emulsion type of food products. The apparatus comprises a source unit (a) for components that are used to make a base product and a source unit (b) for post-added ingredients. It is preferred that the apparatus comprises separate mixers for each family of post-added ingredients.

7 Claims, 3 Drawing Sheets

APPARATUS AND METHOD FOR MIXING COMPONENTS

Figure 1:
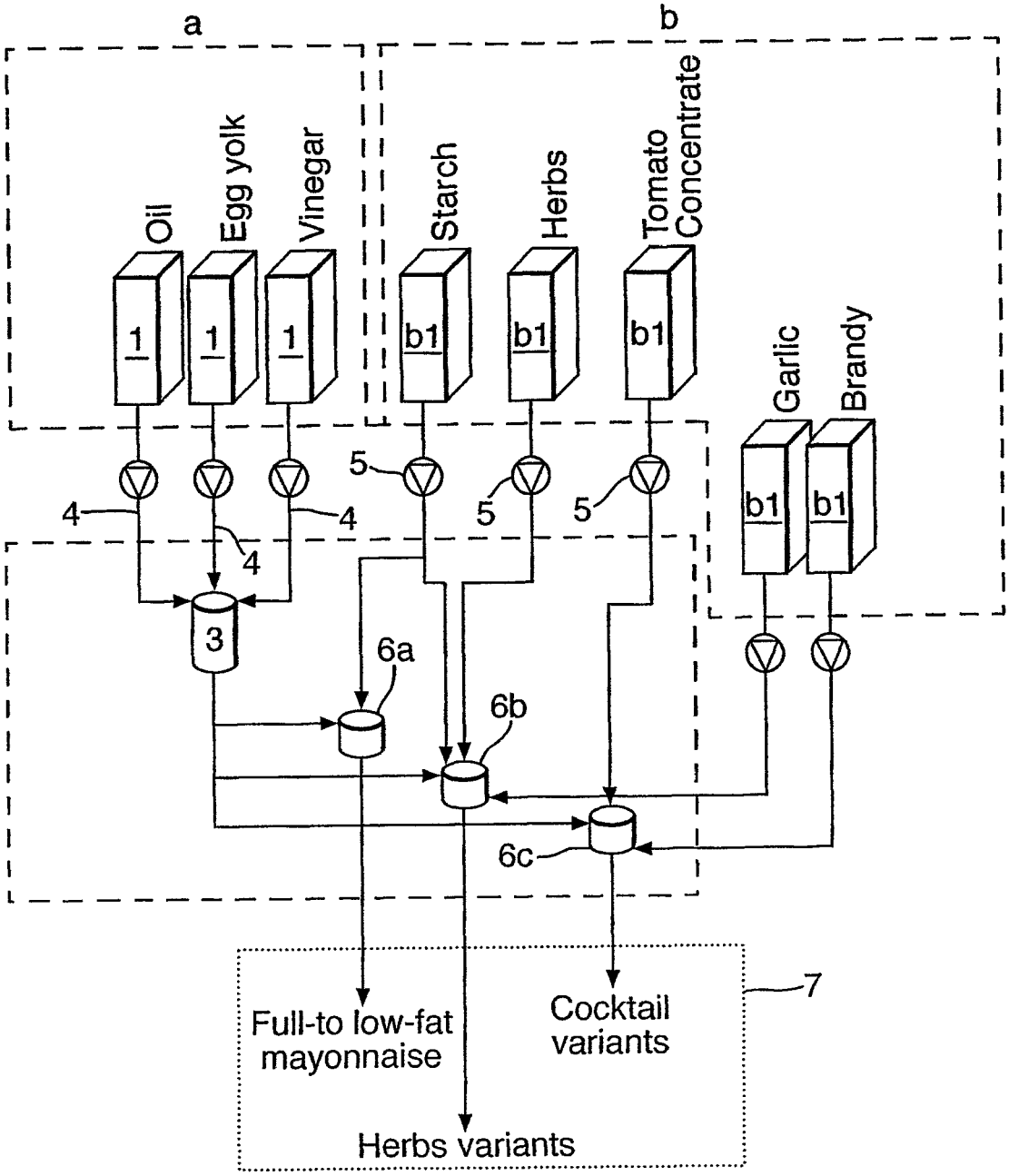

This is a Divisional Application of co-pending U.S. patent application Ser. No. 10/568,562, filed Feb. 17, 2006, which is a national stage application under 35 U.S.C. §371 of PCT International Application PCT/EP2004/008255 filed Jul. 23, 2004, which claims priority under 35 U.S.C. §119 to EP Application No. 03077612.4 filed Aug. 21, 2003; all of which are incorporated herein in their entirety, by reference.

FIELD OF THE INVENTION

The invention relates to an apparatus for mixing components for the preparation of emulsion type food products.

BACKGROUND OF THE INVENTION

Dressings, spreads, sauces and other oil and water emulsion based products are well known. Over the years the number of different variants that is available for such emulsions has grown. When made at home, consumers can make their personal dressing or sauce variant and add the desired ingredients to match their liking. There is also a trend in society to obtain a ready meal or parts of the meal from a restaurant or store without the need to do any cooking activity yourself. It is evident that the variety provided via a restaurant, store or other retail outlet is limited because of the amount of time it takes to make personalized emulsion type products. Also the amount of product purchased if a large variety is offered is very low, and often too low to justify the preparation of each particular variant.

U.S. Pat. No. 6,280,075 discloses a plant for continuously preparing at least two different liquid foodstuff mixtures. This document addresses the problem that for the preparation of a variety of beverages in a factory, plant portions which treat basically mixture components, e.g. in case of beverages water and sugar solution, must be present two fold or in a plurality of numbers, causing correspondingly high procurement and operating costs. According to US'075 this problem is solved by a plant system in which only one single plant portion is needed for the mixture components, which is common to the several foodstuff mixtures. In one embodiment, each product has dedicated mixers, buffers and filling machines. Hence the variety of product prepared in such plant is still limited. Variation within a certain recipe is not possible. A change of recipe means that all mixers, buffer tanks and the filling machine have to be cleaned to avoid contamination of the next product. In another embodiment, all product variants use a common mixer. This mixer needs cleaning for each recipe switch.

Another existing desire is the desire for fresh products. Food products that are prepared in a factory may not fulfill this desire and hence methods have been developed to provide food products, e.g. emulsions that are prepared on the spot from their raw ingredients, mainly oil and water.

Furthermore providing a particular product variant may cost a lot of time for preparation, which is undesired for the consumer who may wish to take or consume the product immediately.

To overcome the latter problems, ways have been developed which provide a metered amount of emulsion, prepared instantaneously and if desired on demand. Instant in this context is referring to "on the spot", within a short time in the order of seconds to minutes. An example of a suitable dispensing unit is disclosed in WO-A-01/00521. The dispensing unit disclosed therein is a bottle which stores two or more separate fluids and blends the fluids when dispensing. The two fluids may be oil and vinegar to prepare dressings. The amount of different products that may be prepared using such a dispenser is rather limited and the most advantageous property of this unit is that it enables creating a fresh emulsion instantaneously.

Furthermore the size of this dispensing unit, which is manually operated, is not enabling efficient preparation of individually adapted emulsion type products instantaneously for example in a fast food service restaurant.

U.S. Pat. No. 5,230,443 addresses the need for a reliable, relatively inexpensive apparatus and method for dispensing a variety of condiments through a single dispensing unit in a metered quantity and at a low flow rate. Providing a device, which comprises a pump, which is fluidly connected to a condiment source and a dispensing apparatus, solves this need. Multiple pumps (e.g. 3) may be included wherein each pump is connected to a different condiment source. This enables independent dispensing of e.g. 3 different types of condiment. Again this offers only limited variety and requires a separate condiment source for each type of condiment offered. Also the products obtained from this device are not fresh products.

One of the known problems associated with apparatus' that provide a variety of products with different recipes is cross contamination between products that are of different composition but dispensed through the same nozzle. U.S. Pat. No. 4,753,370 discloses a mixing nozzle that can mix different flavours into a product stream, without cross contamination. This is achieved by mixing the flavour in-line into a flowing aqueous stream wherein the flavour is injected such that the flavour does not touch any of the nozzle housing. This solution may be suitable for low viscosity beverages wherein homogeneous mixing is relatively easy but was found to be unsuitable for homogeneously mixing oil and water compositions which are more viscous. Generally oil and water emulsions are either pourable or spoonable and the higher the viscosity, the more cross contamination may be occurring.

In summary the flexibility provided by the prior art devices is low. Either the known dispensers are fed with finished products and only able to deliver this on demand, or the instant preparation of product delivers fresh product with no or limited variety in product composition or high contamination when switching to a new variety.

Therefore it is an object of the invention to provide an apparatus, which dispenses a variety of products without the need to clean and rinse the entire apparatus on switching to a different variety.

DEFINITION OF THE INVENTION

The present invention seeks to solve this problem by providing an apparatus, which comprises means enabling post-addition of ingredients wherein these ingredients are arranged in families of ingredients.

Thus, the present invention provides an apparatus for preparing and dispensing an oil and water containing emulsion comprising one or more post-added ingredients, the apparatus comprising a frame comprising

- a source unit (a) comprising one or more component reservoirs (1);
- selection means for selecting the desired components and/or their ratio
- a source unit (b) for post-added ingredients wherein the post-added ingredients (b1) are arranged in at least two families;

selection means for selecting the desired post-added ingredients;

processing means (2) suitable for mixing the components from the component reservoirs and the post-added ingredients;

a dispensing unit (7) for dispensing the resulting oil and water emulsion, wherein the configuration of the apparatus is such that changes in recipe of the oil and water emulsion do not require intermediate cleaning of the apparatus.

In another aspect the invention relates to an apparatus for preparing and dispensing an oil and water containing emulsion comprising one or more post-added ingredients, the apparatus comprising a frame comprising a source unit (a) comprising one or more component reservoirs (1);

selection means for selecting the desired components and/or their ratio a source unit (b) for post-added ingredients (b1) wherein the post-added ingredients are arranged in at least two families;

selection means for selecting the desired post-added ingredients;

processing means (2) comprising mixing means suitable for mixing the components from the component reservoirs and the post-added ingredients;

a dispensing unit (7) for dispensing the resulting oil and water emulsion, wherein the volume of the mixing means is small in comparison to the volume of the product that is dispensed.

The invention also relates to a method for preparing an emulsion type product using such apparatus.

DETAILED DESCRIPTION OF THE INVENTION

The apparatus is suitable for preparing, mixing and dispensing oil and water containing emulsions, especially edible oil and water containing emulsions. Examples of such emulsions are dressings, mayonnaise, sauces, yoghurts, spreadable products such as margarine, and fresh cheese type of products. The apparatus is particularly suitable for the preparation of mayonnaise or dressing type of products and for the preparation of products with limited stability such as vinaigrette, which easily separates into an aqueous phase and an oil phase on storage. An advantage of the apparatus according to the invention is that it enables the preparation of a product on the spot. The freshness of such products is increased compared to products that are produced in a factory. Furthermore the products produced with this apparatus do not need the inclusion of preservatives because they are readily made and consumed shortly after their preparation. This increases the taste and flavour quality of the products.

In the context of the invention the term "mixing" comprises blending and emulsification.

Figure 2:
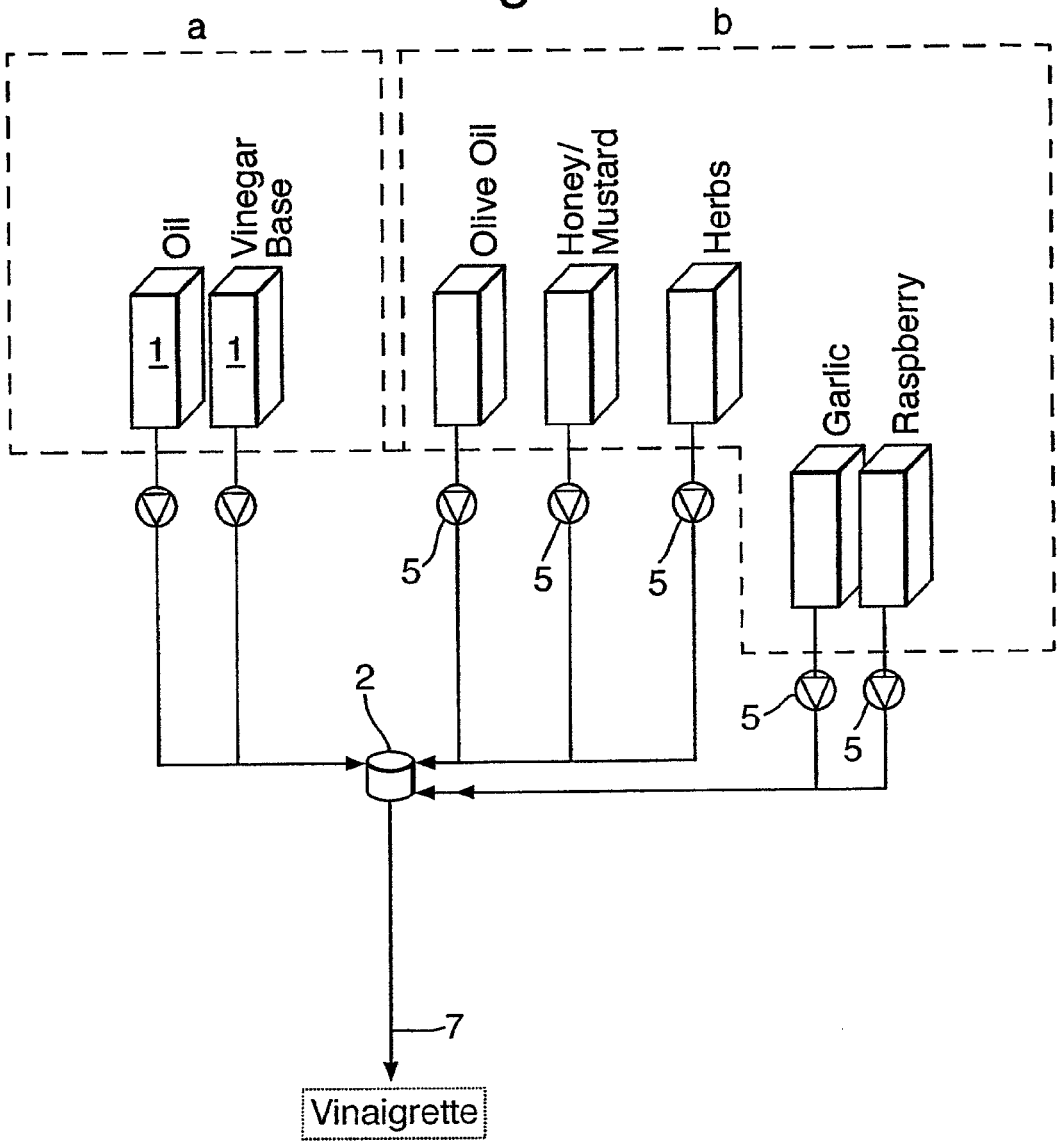
Figure 3:
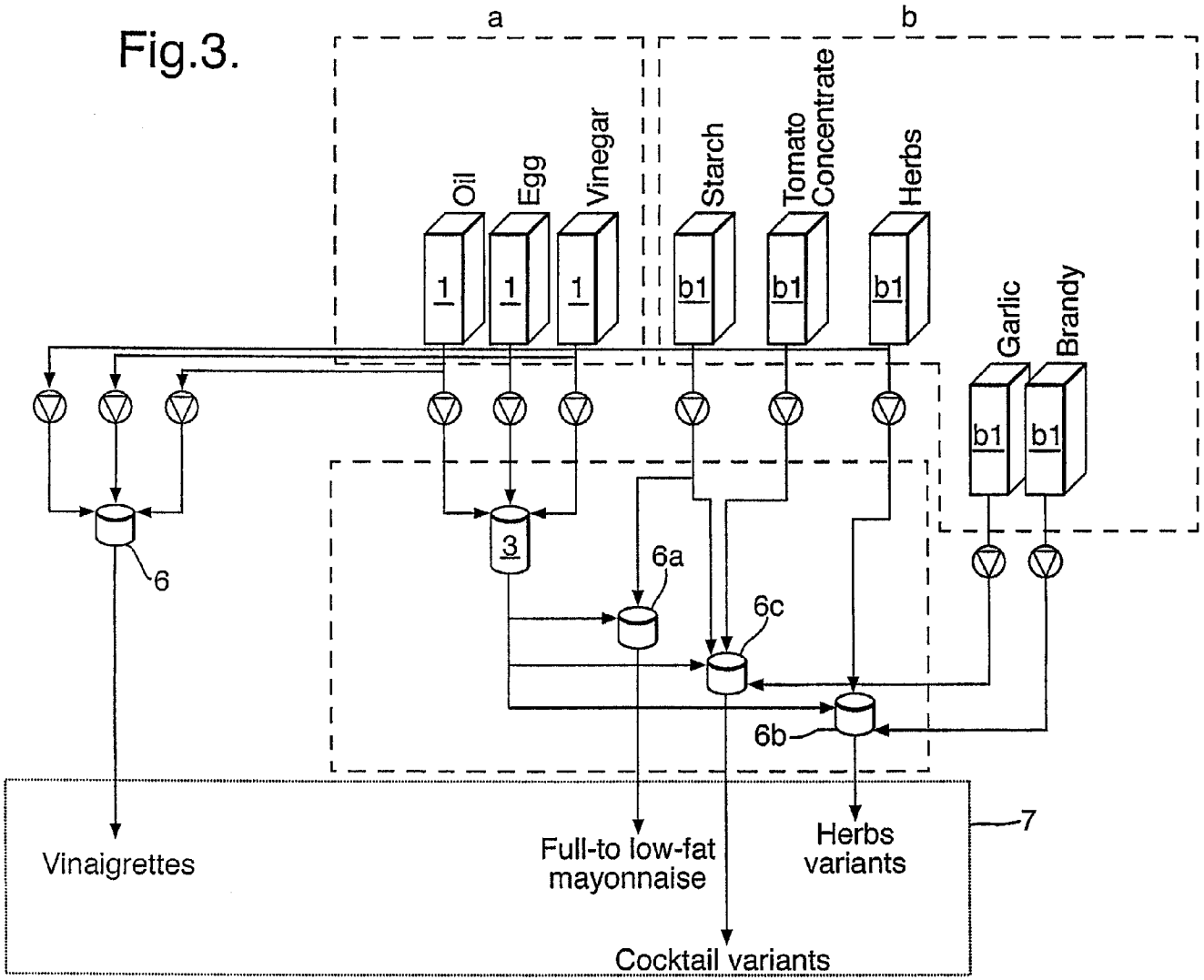

Hereinafter the invention will be elucidated while referring to the drawings. In these drawings:

FIGS. 1, 2 and 3 show schematic embodiments of the apparatus according to the invention.

Before giving a detailed description of the figures, the following is noted. In FIGS. 1, 2 and 3 a preferred embodiment of the apparatus according to the invention is shown. Only parts of the apparatus essential for understanding the invention have been illustrated. It will be appreciated that the apparatus will further comprise the general means for making it function such as pumps, lines/conduits, valves, control panels, electricity inlet and the like.

The apparatus is adapted for use by consumers, as opposed to use in a factory. In the context of the invention the term consumer refers to an individual person who is either end consumer or e.g. assistant in a shop or restaurant and who operates the apparatus. For some applications the apparatus may offer a relatively high throughput in the range of up to thousands of kilograms per hour.

The apparatus functions in a batch mode contrary to the known continuous preparation in factories. The apparatus is suitable for use in a batch process and for dispensing only one product at a time.

The apparatus comprises a frame or housing which comprises most elements, preferably all elements. Optionally some of the reservoirs may be placed outside the housing, depending e.g. on their size. Placing some of the reservoirs outside the housing may also make them more easy to handle for refilling and/or changing.

The apparatus comprises a source unit (a) comprising one or more component reservoirs (1). According to one embodiment, the source unit comprises separate reservoirs for ingredients that are used to make a base product. Examples of these ingredients are an oil phase, aqueous phase and optionally emulsifier. These components are the basic ingredients for providing an oil and water type of emulsion. It will be appreciated that from these basic ingredients any type of final product with a variety of texture, viscosity, appearance and taste may be prepared.

Optionally the source unit (a) comprises more than 1 reservoir for the same ingredient, e.g. two oil reservoirs. This set up may be used when the level of one ingredient in the product is very high, e.g. a level of 80% oil in a mayonnaise.

Alternatively or in addition to the above ingredients, the apparatus comprises reservoirs comprising a base product which is a mixture of ingredients such as e.g. a sauce base, a mayonnaise base, a dressing base, a margarine base or a concentrated tomato base. In a preferred embodiment, the base is a product that does not have a dominant taste or flavour. In an alternative embodiment, the base is a concentrate.

Optionally an aqueous phase reservoir is in the form of a connection to tap water.

The source unit (a) may be physically recognisable as one separate unit in the apparatus. Alternatively certain reservoirs that belong to the source unit (a) are placed at a different location in the apparatus as that may lead to more efficient use of space. As mentioned above optionally one or more reservoirs that are part of the source unit (a) are placed outside the apparatus.

The apparatus is provided with selection means to enable the selection of a particular ingredient, base product or combination thereof from the reservoirs in source unit (a). In addition thereto the selection means may be such that it enables the selection of a ratio of volumes of the particular ingredient or base product. Alternatively the volumes are set volumes which can not be individually adapted. Preferably the apparatus comprises an interface which enables a consumer to select one or more end products for production.

The reservoirs are connected to a processing means (2). The processing means comprises an inlet for components originating from the reservoirs (1) and for post-added ingredients. The processing means should be suitable for mixing the ingredients originating from the reservoirs in source unit (a) and the post-added ingredients. It is therefore preferred that the processing means is a mixer such as a static mixer or a dynamic mixer, or a series of mixers. Although the use of one or more mixers is preferred to obtain homogeneous end products, optionally mixers are eliminated. The elimination of the mixer may be used to provide special effects e.g. red tomato striping on mayonnaise.

Optionally the processing means is provided with a heating or cooling element, a shear device such as a homogeniser, or an ultrasound generator. Examples of a suitable heating element are a microwave generating unit, inductive heating element and an ohmic heating element. The ultrasound generator may e.g. be used for emulsification or solubilisation.

According to a preferred embodiment, the processing means comprises a pre-mixer (3) for mixing the ingredients from the component reservoirs in source unit (a) before adding any post-added ingredients from source unit (b). The inclusion of a premixer is highly preferred for the preparation of emulsions such mayonnaise when starting from the raw ingredients in stead of a base product. For further details on the apparatus suitable for preparing emulsions such as mayonnaise, reference is made to FIG. 1 and the description thereof.

The apparatus is suitable for preparing a variety of oil and water containing emulsions with different recipes. Depending on the selection made by a consumer, a different type and/or amount of post-added ingredients is included in the recipe. In a most suitable configuration the apparatus is such that one dosing unit is dispensed after the selection of a recipe. In the apparatus the configuration is such that changes in recipe of the oil and water emulsion do not require intermediate cleaning of the apparatus. In an even more preferred embodiment, the configuration of the apparatus is such that the amount of product residue contaminating a subsequent product that is dispensed, is less than 5 vol %, more preferred less than 1 vol % of the subsequent product.

To eliminate the need for intermediate cleaning on change of recipe, the apparatus comprises at least one source unit (b) wherein the post-added ingredients are grouped in at least two families.

Post-added ingredients are defined as ingredients that can be added to a base product to differentiate it and which preferably require little or no shear to be included in the products.

Each family of post-added ingredients is composed of at least 1 ingredient, preferably at least 2 ingredients, more preferred from 3 to 10 ingredients. Each family of post-added ingredients is composed such that each member thereof is highly similar in colour, taste and consistency such that little residue that may remain in the mixer will not have an adverse effect on the perception of the product by the end-user.

As indicated above, one of the main problems known from the art is cross-contamination between subsequent products. This problem is especially present for relatively viscous products such as products which are pourable or spoonable. Pourable products suitably will have a viscosity in the range of 0.1 to 40 dPa·s (deci-Pascal·s) when measured with a Haake viscosimeter type VT02, measured with head No. 3, in measure beaker with 5 cm diameter at a temperature of 5 or 10° C., measured after a few seconds when value is about constant, rotation speed being 62.5 rotations per minute (rpm). The measurement is to be carried out 3 days after preparation of the emulsion and storage at 5° C. In such cases the cross contamination may arise due to back mixing. This problem is less apparent in non-viscous fluids such as water and soft drink beverages.

Most preferred a consumer would not notice cross contamination with previously made product. Although it is possible to mix all post-added ingredients with the components from the reservoirs of source unit (a) in one mixer, it is highly preferred that the processing means comprises dedicated mixing units for each family of ingredients. Therefore e.g. strong flavours will require a separate post-mixer.

Examples of preferred families of post-added ingredients are: herbs, colorants, flavourings, thickeners such as starch; pastes such as tomato, avocado pastes; fresh dairy ingredients such as fresh cheese, yoghurt; benefit agents such as vitamins, fortifiers; ingredients for preparing a cocktail sauce e.g. brandy, tomato concentrate; ingredients for preparing white dressings e.g. starch in water, cheese, yoghurt, cream, quark.

The composition of the families may be such that there is overlap between the ingredients. For example one family may be the family of structuring agents which includes as ingredients a starch containing composition, a yoghurt and a fresh cheese base. Another family may be the family of flavouring agents which may include yoghurt or it's concentrate as well.

The apparatus further comprises means (5) for feeding the post-added ingredients. Examples of such means are pipes, ducts or tubes that form a connection between the source unit (b) for post-added ingredients and the processing means. Furthermore feeding means may comprise a pump to cause a portion of the post-added ingredients to flow into the processing means. Alternatively feeding means comprise dosing means for dosing a liquid or a powder in the processing means. These dosing means are preferably suitable for in line feeding.

The apparatus comprises means for selecting the desired type and amount of post-added ingredients. This enables an individual user of the apparatus to select his own desired composition in terms of type of base product on the one hand and type and amount of post-added ingredients on the other hand.

The apparatus further comprises a dispensing unit (7). The dispensing unit is positioned after the last mixer that is part of the processing means (2). To minimise the volume of the previous product in a subsequent product having a different recipe, the volume of the conduits between the last mixer of the processing means (2) and dispenser (7) is preferably as small as possible. It is preferred that the volume of the conduits between the last mixer, which is usually the mixer used for mixing post-added ingredients, and the dispensing unit is less than 20 vol %, more preferred less than 10 vol %, most preferred less than 5 vol % of the dispensing volume.

Furthermore, in all embodiments of the invention, the volume of the mixing means is preferably small in comparison to the volume of the product to be dosed. E.g. a ratio of from 1 volume unit for the mixer to at least 5 volume units for the dosed product, preferably 5-100 volume units, more preferred 10 to 40 volume units for the dosed product was found suitable. The small volume of the post-mixer in comparison to the next product dose is believed to have the following benefit. When the customer changes the recipe, only a small part of the next dose will contain the previous product. This allows to feed more post-added ingredients through the same post-mixer.

The apparatus according to the invention may be operated manually but it is preferred to have it controlled automatically e.g. via a computer with touch screen or a PLC or other alternative electronic devices. Preferably the pumps are electrically driven and controlled.

In a preferred embodiment, the apparatus comprises a pump regulator module connected to each reservoir. A programmable control module may be connected to the pump regulator module for controlling and dispensing a predetermined amount of product.

The apparatus may be placed at any spot in a restaurant, store or other retail outlet. It is preferred that the size is such that it fits on a regular counter, or could be stand-alone. The preferred size of the reservoirs in the apparatus depends on the product formulation and the allowed interval in between re-filling (e.g. 0.5 liter for flavours, 10 liters for oils). On locations with high throughput some or all the reservoirs may be remote from the processing part and much larger in size (e.g. 100 liters of oil).

The preferred dispensing volume is from 1 to 200 ml prepared within 1 to 60 seconds.

Optionally the apparatus comprises a storage unit for bottles or other packaging material in which the product may be dispensed. Such storage unit may be positioned such that a consumer manually takes a bottle and places it under the dispensing unit. Alternatively the apparatus is constructed such that the selection of a metered amount of product triggers the automatic placement of a bottle or other packaging material to receive the dispensed product.

Optionally the apparatus is provided with a cleaning unit that may be used to regularly clean the apparatus (semi) automatically. This cleaning is meant to comply with microbiological safety requirements but is not needed if the recipe is changed between subsequent products.

The apparatus according to the invention may be provided with means for cooling and/or heating the reservoirs for example a chilled reservoir to keep egg-yolk or another phase stable for a longer period. Optionally the apparatus comprises an electrically heated reservoir to give fats/oils a lower viscosity. Thus, the circumstances for preparing the product may be controlled temperature-wise.

Optionally the product is directly dispensed on a plate to be combined with other food or directly on a final food preparation.

it is preferred that the main components of the apparatus are made of a suitable, easy to clean material. Examples of suitable material are stainless steel, plastics. The tubes are preferably made of material compatible with the ingredients, e.g. neoprene, silicone, viton etc.

For the preparation of dressings it is most preferred that the reservoirs comprise at least an oil phase, vinegar and egg yolk. Optional post-added ingredients are herbs, starch, garlic, and tomato concentrate such as ketchup.

For the preparation of sauces the reservoirs in source unit (a) preferably comprise an oil phase and an aqueous phase. Optional post-added ingredients are starch, thickener, herbs, spices, vegetable (pieces), colorant, preservatives. Optionally the oil phase is replaced by another structuring phase such as a tomato or avocado base which derive their structuring capability from the presence of plant fibres.

For the preparation of spreadable products the reservoirs in source unit (a) preferably comprise an oil phase, an aqueous phase and emulsifier. Optional post-added ingredients are benefit agents such as vitamins, thickeners such as starch, gums, preservatives, vitamins; colorants and salt.

FIG. 1 shows an embodiment of an apparatus for mixing components for the preparation of emulsion type products. The apparatus comprises a source unit (a) comprising component reservoirs (1). The component reservoirs are connected to a pre-mixer unit (3) suitable for creating an oil and water emulsion. In one embodiment, the source unit comprises separate reservoirs for oil phase, aqueous phase and emulsifier. These components are the basic ingredients for providing an oil and water type of emulsion.

The pre-mixer unit (3) should be selected such that the product resulting from the pre-mixing operation is an emulsion. Generally this is obtained by using a pre-mixer which imparts sufficient shear to create an oil and water emulsion. Suitable characteristics of the pre-mixer are that it comprises a part wherein a coarse emulsion is prepared, preferably having an average droplet diameter (D 3,2) of less than 20 micrometer, such as by using a pin stirrer unit, and a high shear part wherein the emulsion is made fine, preferably to an average droplet diameter (D 3,2) of less than 10 micrometer, more preferred less than 5 micrometer. Generally for example a static mixer could be suitable but in cases where a fine emulsion is required it is preferred to use a dynamic mixer consisting of a rotating shaft with impeller and a housing. It is appreciated that there are alternative means to make an emulsion e.g. by electric fields, ultra-sound etc.

The reservoirs are connected to the pre-mixer via tubes (4).

In a preferred embodiment the reservoirs are connected to the pre-mixer unit via positive displacement pumps. These pumps enable accurate dosing of ingredients into the pre-mixer unit.

The post-added ingredients are stored in reservoirs (b1) in source unit (b). They are preferably mixed into the emulsion created in the pre-mixer via a mixing unit (6). Although the use of post-mixers is preferred to obtain homogeneous end products, optionally they are eliminated. The elimination of the post-mixers may be used to provide special effects e.g. red striped products.

According to another embodiment, part of the post-added ingredients are added by in-line addition which eliminates the need for dedicated mixers. This in-line addition may for examples be used for the addition of certain flavour concentrates.

To avoid cross-contamination of the different variants that may be dispensed, the processing means preferably comprises a dedicated mixer (6) for each family of post-added ingredients.

In use a consumer will obtain a container which is placed beneath the dispensing unit (7). The consumer chooses the type of product, amount and variety by pressing buttons on a control panel.

In an even more preferred embodiment the apparatus according to FIG. 1 is used for the preparation of a dressing. In this embodiment, the source unit (a) comprises three reservoirs; one for an oil phase, one for an aqueous phase and optionally one for emulsifier, preferably egg yolk. The preferred aqueous phase is vinegar for these products. In operation, from 30 to 80 wt % oil phase, from 20 to 70 wt % aqueous phase preferably including emulsifier preparation are dosed into the pre-mixer unit (3) by the operation of selection means. In the pre-mixer unit an oil in water emulsion is prepared to result in a dressing-base. The dressing base is subsequently dosed into a mixing unit (6). To this mixing unit, post-added ingredients are added. The preferred post-added ingredients that are selected via the selection means are one or more from the family of herbs, one or more from the family of sweet flavouring agents, one or more from the family of salty flavours, and one or more of the family of structuring agents such as starch and other thickeners or gelling agents. If herbs are added they are preferably pre-dispersed in an aqueous composition to facilitate their dosing. For the preparation of a reduced fat dressing, base product created in mixer (3) is mixed with an aqueous phase containing starch in mixer (6*a*). The resulting product is dispensed via a dispensing tube that is connected to the mixer (6*a*). For the preparation of a herb variant, herbs, starch phase and garlic are mixed with the base product in mixer (6*b*). The resulting product is dispensed via a dispensing tube that is connected to the mixer (6*b*). For the preparation of a cocktail sauce variant tomato concentrate and brandy are mixed with the base product in mixer (6*c*). The resulting product is dispensed via a dispensing tube that is connected to the mixer (6*c*).

Hence the apparatus according to FIG. 1 is suitable for dispensing a variety of products chat can be selected by a consumer without the need for extensive cleaning operations when there is a product switch.

In FIG. 2 an apparatus according to the invention is shown for preparing vinaigrette.

In this embodiment, the source unit (a) comprises two reservoirs; one for an oil phase, one for an aqueous phase. The preferred aqueous phase is vinegar for these products. In operation, from 30 to 80 wt % oil phase and from 20 to 70 wt % aqueous phase are pumped co mixing unit (6). To this mixing unit, post-added ingredients are added. The preferred post-added ingredients that are selected via the selection means are one or more from the family of herbs, one or more from the family of oils and one or more from honey and mustard and one or more from a flavour concentrate such as raspberry concentrate. In processing means (2) all ingredients are blended in a mixer and subsequently the resulting vinaigrette is dispensed via dispensing unit (7). By selecting only olive oils for addition to the blend of oil and vinegar, a classical vinaigrette may be prepared. The selection of a combination of herbs and garlic concentrate enables the formation of herb and garlic vinaigrette. The selection of addition of honey/mustard to the blend of oil and vinegar, a honey/mustard vinaigrette is prepared. The mere addition of raspberry flavour to the blend of oil and vinegar in mixer (6) leads to formation of a raspberry vinaigrette.

FIG. 3 shows an apparatus that is suitable for preparing a dressing and a vinaigrette. In this apparatus the source unit (a) is shared between the two different product streams. Selection means enable the preparation of one product which is a dressing or a vinaigrette. For the preparation of the vinaigrette the pre-mixer (3) need not be included in the process. For the preparation of dressings the process includes treatment with the pre-mixer (3) and further in (preferably dedicated) post-mixers (6*a*, 6*b*, 6*c*).

In a further aspect the invention relates to a method for mixing components for the preparation of emulsion type products, using an apparatus according to the invention wherein post-added ingredients arranged in families and are added to a base product by addition of the post-added ingredients via dedicated mixers for each individual family.

In case of the preparation of a dressing type of product, it is preferred that the reservoirs are provided with an oil phase, an aqueous phase below pH 3.8 and an emulsifier, said oil phase, aqueous-phase and emulsifier are pumped to a pre-mixer creating an emulsion, followed by adding ingredients from the group comprising herbs, fruit or vegetable concentrates, colorants, flavourings, vitamins, starches solutions, pastes fresh cheese, yoghurt, via dedicated post-mixers and dispensing the dressing. The oil phase may comprise ingredients such as beta-carotene before the emulsion is prepared.

The invention is not limited to the embodiments described before, which may be varied widely within the scope of the invention as defined by the appending claims.

The invention claimed is:

1. A method for a consumer preparing and dispensing an oil and water containing emulsion comprising one or more post-added ingredients using an apparatus comprising a frame, said apparatus further comprising a source unit (a) comprising reservoirs (1) for a plurality of base components, said reservoirs (1) including an oil phase reservoir, an aqueous phase reservoir, and, optionally, an emulsifier reservoir;

selection means for selecting the desired base components and/or their ratio;

a pre-mixer (3) for preparing an emulsified base from the base components;

a source unit (b) for post-added ingredients (b1) wherein the post-added ingredients are arranged in at least two families;

selection means for selecting the desired post-added ingredients;

processing means (2) comprising dedicated mixing means (6) for each family of post-added ingredients, said mixing means being suitable for mixing the emulsified base and the post-added ingredients;

a dispensing unit (7) for dispensing the resulting oil and water emulsion;

said method comprising the steps of:

(i) the consumer, to whom the apparatus has been provided for use, placing a container beneath the dispensing unit (7);

(ii) the consumer choosing the type of product, amount and variety;

(iii) the pre-mixer (3) mixing the selected base components to form an emulsified base, and the base so formed being dosed from the pre-mixer into the dedicated mixing means for the selected family of post-added ingredients;

(iv) the mixing means mixing the base and the selected post added ingredients; and (v) the dispensing unit dispensing the resulting oil and water emulsion into the container;

wherein the volume ratio of the volume of the emulsion that is dispensed to that of the mixing means is at least 5:1.

2. The method according to claim 1 wherein the oil and water containing emulsion is a food product that is a dressing and the source unit (a) comprises separate reservoirs (1) that provide an oil phase, an aqueous phase having a pH below 3.8 and an emulsifier, wherein said oil phase, aqueous phase and emulsifier are pumped to the pre-mixer creating an emulsion, and post-added ingredients (b1) are selected from the family of herbs, the family of colorants and the family of flavourings.

3. The method according to claim 1, wherein the families of post-added ingredients (b1) are selected from the group consisting of flavouring agents, structuring agent, herbs and colourants.

4. The method according to claim 1, wherein the source unit (a) further comprises separate reservoirs (1) for one or more compositions selected from the group consisting of tomato base, mustard, mayonnaise base, dressing base and sauce base.

5. The method according to claim 1, wherein each family of post-added ingredients is composed such that each member thereof is highly similar in colour, taste and consistency.

6. The method according to claim 1, wherein the dispensing unit (7) is suitable for use in a batch process and dispensing only one product at a time.

7. The method according to claim 1, wherein the apparatus is provided to the consumer in a shop or restaurant.

* * * * *